US012610995B2

(12) United States Patent
Blythe

(10) Patent No.: US 12,610,995 B2
(45) **Date of Patent: *Apr. 28, 2026**

(54) SPORTS BAND ARTICLE

(71) Applicant: Drymax Technologies, Inc., Paso Robles, CA (US)

(72) Inventor: William A. Blythe, Paso Robles, CA (US)

(73) Assignee: DRYMAX TECHNOLOGIES, INC., Paso Robles, CA (US)

( * ) Notice: Subject to any disclaimer, the term of this patent is extended or adjusted under 35 U.S.C. 154(b) by 487 days.

This patent is subject to a terminal disclaimer.

(21) Appl. No.: 17/962,914

(22) Filed: Oct. 10, 2022

(65) Prior Publication Data

US 2023/0029469 A1 Feb. 2, 2023

Related U.S. Application Data

(63) Continuation of application No. 15/064,703, filed on Mar. 9, 2016, now Pat. No. 11,464,265.

(60) Provisional application No. 62/130,366, filed on Mar. 9, 2015.

(51) Int. Cl.

| | |
|---|---|
| ***A41D 20/00*** | (2006.01) |
| ***D04B 1/02*** | (2006.01) |
| ***D04B 1/24*** | (2006.01) |

(52) U.S. Cl.

CPC ..... *A41D 20/00* (2013.01); *D04B 1/24* (2013.01); *D04B 1/02* (2013.01)

(58) Field of Classification Search

None

See application file for complete search history.

(56) References Cited

U.S. PATENT DOCUMENTS

| | | | | | |
|---|---|---|---|---|---|
| 243,252 | A | | 6/1881 | Harbison | |
| 413,749 | A | | 10/1889 | Carrier | |
| 668,800 | A | | 2/1901 | Knapp | |
| 872,137 | A | | 11/1907 | Lauferty | |
| 1,697,919 | A | | 1/1929 | Knepper | |
| 1,981,057 | A | * | 11/1934 | Lombardi | D04B 1/10 66/190 |
| 2,016,210 | A | * | 10/1935 | Mann | A41D 20/00 D2/877 |
| D99,164 | S | | 3/1936 | Levine | |
| 2,127,926 | A | | 8/1938 | Mason | |

(Continued)

FOREIGN PATENT DOCUMENTS

| | | | |
|---|---|---|---|
| AU | 2007246238 | A1 | 11/2007 |
| AU | 2008200440 | A1 | 3/2010 |

(Continued)

OTHER PUBLICATIONS

"Black 4" Wrist Sweatband Customizable Number for All Sports" Posted Apr. 21, 2008. Couver. https://x.couver.us/index.php?main_page=product_info&cPath=69_81_179&products_id=830.

(Continued)

*Primary Examiner* — Thomas J Kessler

(74) *Attorney, Agent, or Firm* — Christopher J. Knors; Moore & Van Allen PLLC

(57) ABSTRACT

An article of fabric of a generally tubular shape body having an inner skin-facing surface with a generally symmetric inner circumference and an outer-facing surface having a generally non-symmetric outer circumference.

14 Claims, 11 Drawing Sheets

(56) References Cited

U.S. PATENT DOCUMENTS

D160,416 S 10/1950 Mueller
D163,988 S 7/1951 Breath
2,591,905 A 4/1952 Bert
2,643,389 A 6/1953 Oscar
4,014,046 A 3/1977 Craig
4,047,400 A 9/1977 Thorneburg
D257,884 S 1/1981 Ternstrom
4,399,567 A 8/1983 Weon Joong
4,499,741 A 2/1985 Harris
4,521,922 A 6/1985 Mitchell et al.
4,843,653 A * 7/1989 Coble ..... D04B 1/22 2/169
D308,436 S 6/1990 Weitzell
4,947,488 A * 8/1990 Ashinoff ..... A63B 71/10 2/DIG. 11
5,119,513 A 6/1992 Mckay
5,297,296 A * 3/1994 Moretz ..... A41C 3/0014 604/358
5,511,214 A 4/1996 Yamada
D370,111 S 5/1996 Walker
D372,878 S 8/1996 Finnegan
5,746,067 A 5/1998 Leach, II et al.
5,823,012 A * 10/1998 Hacskaylo ..... D04B 1/24 66/171
D402,411 S 12/1998 Radler
6,113,565 A 9/2000 Schlup et al.
D433,197 S 10/2000 Niksich
6,192,519 B1 2/2001 Coalter
6,332,225 B1 12/2001 Casey
6,349,414 B1 2/2002 Tillman
D453,985 S 3/2002 Casey
6,383,157 B1 5/2002 Massi et al.
6,425,137 B1 7/2002 Fakhrai
6,701,532 B1 3/2004 Glassberg et al.
D491,829 S 6/2004 Seifert
6,770,581 B1 * 8/2004 DeMott ..... D06N 7/0065 428/96
6,974,366 B1 12/2005 Johnson
D517,442 S 3/2006 Polk, III
D550,112 S 9/2007 Andren et al.
D553,536 S 10/2007 Andren et al.
D556,194 S 11/2007 Rambosek et al.
D558,198 S 12/2007 Blankenship et al.
D569,577 S 5/2008 Barker
D584,972 S 1/2009 Aeberhard et al.
D604,191 S 11/2009 Ohara et al.
D651,535 S 1/2012 Rodarmel
D681,941 S 5/2013 Kennedy et al.
D685,284 S 7/2013 Spano
D705,112 S 5/2014 Namazy
D727,613 S 4/2015 Schoenbeck et al.
D731,345 S 6/2015 Stewart
D738,748 S 9/2015 Bibl et al.
D739,274 S 9/2015 Chen et al.
D743,131 S 11/2015 Jeon et al.
D744,890 S 12/2015 Murphy
D750,902 S 3/2016 Duparc
D753,357 S 4/2016 Song et al.
11,464,265 B2 * 10/2022 Blythe ..... D04B 1/12
2002/0122890 A1 * 9/2002 Linford ..... D06M 15/643 427/389.9
2003/0176904 A1 9/2003 Patterson
2003/0221241 A1 12/2003 Rivera et al.
2008/0000009 A1 1/2008 Kogawa et al.
2009/0007597 A1 1/2009 Hanevold
2009/0151045 A1 6/2009 Hinds et al.
2009/0205106 A1 8/2009 Sohn
2009/0206117 A1 8/2009 Chan
2009/0307825 A1 12/2009 Bhalla
2011/0250979 A1 10/2011 Dean
2013/0047319 A1 * 2/2013 Canale ..... A41D 20/00 2/243.1
2014/0123702 A1 5/2014 Pierce
2014/0245520 A1 9/2014 Bae
2014/0365979 A1 12/2014 Yoon et al.
2015/0049591 A1 2/2015 Adams et al.
2015/0143600 A1 5/2015 House
2015/0309535 A1 10/2015 Connor
2016/0262470 A1 9/2016 Blythe

FOREIGN PATENT DOCUMENTS

WO 9833562 A1 8/1998
WO WO-2007110590 A2 * 10/2007 ..... A47B 21/0371
WO 2007129853 A1 11/2007

OTHER PUBLICATIONS

"Nike Adult Fielder's Wrist Guard" Oct. 8, 2013, Baseball Savings <http://reviews.baseballsavings.com/9058/41799/nike-adult-fielders-wrist-guard-reviews/reviews.htm>.
"Terry cloth sweat wristbands," 2016, <http://terrywristband.com/sweatband/index.php?main_page=product_reviews_info&products_id=275&reviews_id=18&zenid=50523ade7ca25at7aff1b3a9bacif213>.
"Nike Dri-fit Stealth Wristbands" Apr. 8, 2016, Sports Unlimited <http://www.sportsunlimitedinc.com/nike-dri-fit-stealth-wristbands.html>.
"Wrist Sweatband" Apr. 8, 2016, Sadiq Sports <http://www.sadiqsports.com/detail.php?nod=2125>.
MKeegan. "How to Knit: Swiss Darning. " Woman's Weekly, Aug. 28, 2013; www.womansweekly.com/knitting/how-to-guide-swiss-darning-12822/ (Year: 2013).
"Terry cloth sweat wristbands" Mar. 16, 2009. Terrywristband.com; https://terrywristband.com/sweatband/index.php?main_page=product_info&cPath=23_50&products_id=211&zenid=bb46da98cd315511286095866f91fd56.
"Black Number embridery sweat wristband—No. 8 (eight) embroidered in dark orange thread" Jan. 9, 2015. Couver. https://x.couver.us/index.php?main_page=product_info&products_id=1959.

* cited by examiner

SPORTS BAND ARTICLE

CROSS-REFERENCE TO RELATED APPLICATIONS

This application is a continuation of U.S. patent application Ser. No. 15/064,703, filed Mar. 9, 2016, which claims the benefit of U.S. Provisional Application No. 62/130,366, filed on Mar. 9, 2015, the contents of which are incorporated herein by reference in their entirety.

TECHNICAL FIELD

The present disclosure is related to athletic sweatbands and more specifically to those that are worn on the body, such as the wrist, head, arm, or leg, during participation in a variety of sports. An article of fabric of a generally tubular shape body having an inner skin-facing surface with a generally symmetric inner circumference and an outer-facing surface having a generally non-symmetric outer circumference.

BACKGROUND

Most known wristbands, or "sweatbands" are typically worn around the wrist or head to keep the hands, fingers, or areas around the eyes from contact by perspiration, typically by absorbing the perspiration in the fabric of the article. Such conventional bands are generally made of a terry-knit cloth with an elastic or stretch material woven or otherwise encased therein, or by other means. Typically, such bands, apart from displaying text or other indicia, are not configured so as be worn in a particular way or fashion. Further, known wristbands, or "sweatbands" are typically of symmetric thickness as shown in FIG. 1, where band 30 is shown having inner surface 34 separated by outer surface 36 that is of substantially the same thickness along the longitudinal length. End 32 of band 30 is typically stitched after a desired length of tube is made.

SUMMARY

In some embodiments an article of fabric comprises a tubular-like body, a first open end, a second open end; an outer surface having an outer circumference; an inner skin-facing surface having an inner circumference, the inner surface separated from the outer surface by a thickness of fabric, a first portion of a first thickness, and a second portion of a second thickness, the first thickness different from that of the second thickness along a substantially continuous length of the tubular-like body.

In one aspect, the first thickness is different from that of the second thickness along the entire length of the tubular-like body. In another aspect, alone or in combination with any of the previous aspects, a difference in the first thickness and the second thickness is substantially the same along the longitudinal length of the article.

In another aspect, alone or in combination with any of the previous aspects, the inner circumference is sized for a secure fit around a wrist and/or lower arm, head, or leg portion of a wearer.

In another aspect, alone or in combination with any of the previous aspects, the fabric comprises hydrophobic or hydrophilic fibers. In another aspect, alone or in combination with any of the previous aspects, the fabric comprises hydrophobic and hydrophilic fibers. In another aspect, alone or in combination with any of the previous aspects, the fabric comprises a metal. In another aspect, alone or in combination with any of the previous aspects, the fabric comprises copper.

In another aspect, alone or in combination with any of the previous aspects, the first portion is a Terry Loop or Pile knit and the second portion is a plain knit.

In another aspect, alone or in combination with any of the previous aspects, the fabric comprises at least one layer of hydrophobic fibers in proximity to the inner skin-facing surface and at least one layer of hydrophilic fibers or a combination of hydrophobic and hydrophilic fibers more distant from the inner skin-facing surface than the layer of hydrophobic fibers.

In some aspects, an article of fabric comprises a generally tubular shape body having an inner skin-facing surface with a generally symmetric inner circumference and an outer-facing surface having a generally non-symmetric outer circumference.

In one aspect, the non-concentricity of the inner circumference is symmetrical about a longitudinal axis of the article. In another aspect, alone or in combination with any of the previous aspects, the thickness of fabric having a first portion of a first thickness extending the length of tubular body and extending about half of a circumference of the tubular body, and a remainder portion of a second thickness less than that of the first thickness. In another aspect, alone or in combination with any of the previous aspects, the first portion is about 1.5 times to about 5 times the thickness of the remainder portion at the second thickness.

In another aspect, alone or in combination with any of the previous aspects, the first portion is a Terry Loop or Pile stitch and the remainder portion is a flat knit stitch.

In another aspect, alone or in combination with any of the previous aspects, the fabric comprises hydrophobic or hydrophilic fibers. In another aspect, alone or in combination with any of the previous aspects, the fabric comprises hydrophobic and hydrophilic fibers. In another aspect, alone or in combination with any of the previous aspects, the fabric comprises a metal. In another aspect, alone or in combination with any of the previous aspects, the fabric comprises copper.

In another aspect, alone or in combination with any of the previous aspects, the fabric comprises at least one layer of hydrophobic fibers in proximity to the inner skin-facing surface and at least one layer of hydrophilic fibers or a combination of hydrophobic and hydrophilic fibers more distant from the inner skin-facing surface than the layer of hydrophobic fibers.

In another aspect, alone or in combination with any of the previous aspects, the hydrophobic yarn has an elongation to break of less than about 30%. In another aspect, alone or in combination with any of the previous aspects, the hydrophilic yarn is nylon, polyester, or acrylic. In another aspect, alone or in combination with any of the previous aspects, the hydrophilic yarn is cotton, cotton synthetic blended, or wool.

In another aspect, alone or in combination with any of the previous aspects, the article includes an ornamental design or indicia thereon configured to be modified by a user. In another aspect, alone or in combination with any of the previous aspects, the indicia is a dropped in knitted shape of at least one segmented structure representing an Arabic number. In another aspect, alone or in combination with any of the previous aspects, at least a portion of the indicia is configured to be color blended or color contrasted with the article fabric adjacent the indicia to present a representation of at least one Arabic numeral.

A method of making non-symmetrical tubular-like article of fabric in a circular knitting machine, the method comprising the steps of: knitting a tubular-like body having a first section of a first thickness; transitioning to a second section having a second thickness less than the first thickness; and joining opposing ends of the tubular-like body. In one aspect, the method comprises the steps of (a) knitting a makeup of elastic fiber; (b) knitting a plain or flat knit comprising hydrophobic fibers; (c) knitting a Terry Loop or Pile welt comprising hydrophobic fibers; (d) transitioning the knitting of step (c) to hydrophilic fibers; (e) transitioning the knitting of step (d) to hydrophobic fibers; and (f) repeating step (b). In another aspect, the method comprises the steps of (a) knitting a makeup of elastic fiber; (b) knitting a plain or flat knit comprising hydrophobic fibers; (c) knitting a Terry Loop or Pile welt comprising hydrophobic fibers; (d) optionally transitioning the knitting of step (c) to hydrophobic fibers; and (e) repeating step (b). In some embodiments, the method further includes the step of knitting a color contrasting design in the knit.

DETAILED DESCRIPTION

Figure 1:
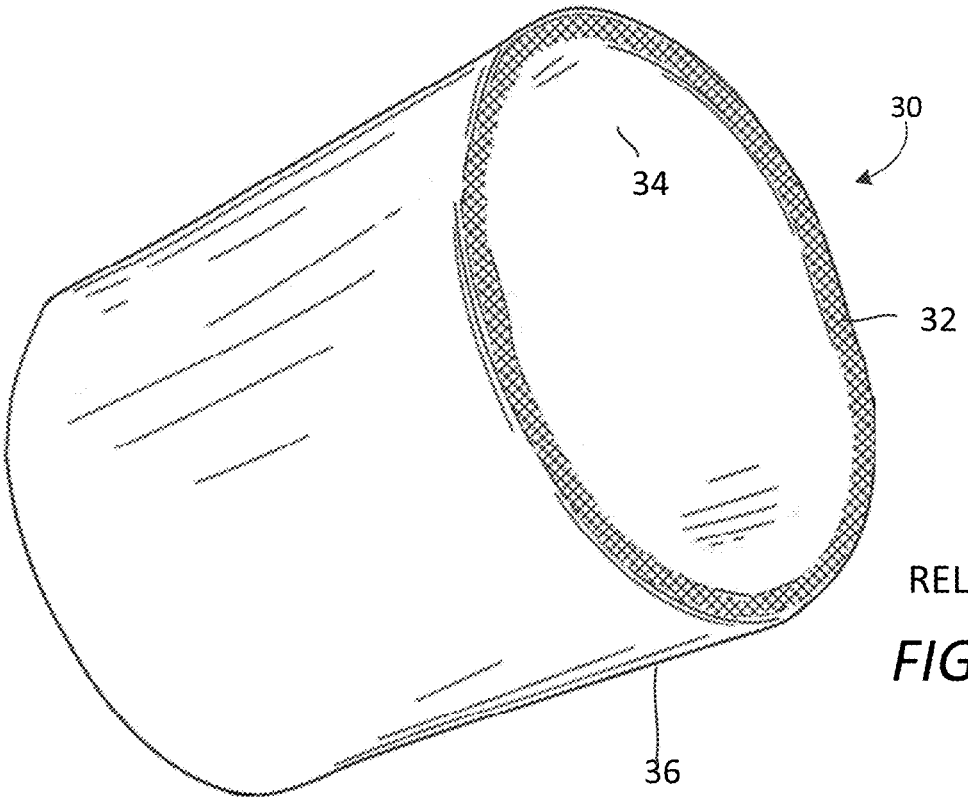
RELATED ART FIG. 1
FIG. 1 is related art of a conventional sweatband.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

As used herein, the term "fabric" refers to any material made through weaving, knitting, spreading, crocheting, or bonding. In one aspect, fabric is inclusive of any material made through knitting or crocheting that may be used in production of an article i.e., garment.

As used herein, the terms "welt" and "knit" as well as their grammatical equivalents are used herein interchangeably.

As used herein, the term "tubular-like" is inclusive of a tubular structure. In certain aspects, the term "tubular-like" is exclusive of a tubular structure having a wall thickness that is essentially the same along the length of the tube.

As used herein, the term "layer" is used to describe at least two courses of knitted fiber yarn and includes fibers interwoven with a layer adjacent thereto. In general, layers of different fibers are readily discernible in magnified cross-sectional views and/or using dyes.

As the subject matter generally refers to fabrics, slight variation in wall thickness due to the nature of knitted welts is to be expected, but generally, a wall thickness variation of less than 10%, would be considered "symmetrical." Whereas, the term "non-symmetrical" as used herein relates to an inner and outer wall thickness change of greater than about 1.5 times, preferably about 1.5 to about 5 times or more, and more specifically, defined sections of longitudinal length having such difference in inner and outer wall thicknesses.

The present disclosure is a unique approach to an athletic "sport band," providing a readily apparent and observable decreased thickness (a thick and a thin section). The article includes plain-knit, relatively snug welt areas and a Terry loop or pile knit which also provides a surface for the knitting in, printing, or other application of an ornamental decorative area or other indicia. In some embodiments, the indicia is configured for modification by the end-user to provide at least one Arabic number and/or letter. The article of the present disclosure can be a welt prepared as a combination of plain knit or single knit with distinct right and wrong sides, with fine ribs running lengthwise on the article's face, and semicircular-like loops running across the reverse face or "skin-facing" side, and Terry loop or pile knit. Other knitting styles and techniques can be used.

In some embodiments, the article comprises a tubular-like construction that is of a stretchable, crosswise plain-knit welt symmetrical with a crosswise Terry loop or pile knit construction of approximately three to seven (3-7) inches in diameter and about one to eight (1-8) inches in length. In some embodiments, the article is configured having a first portion of a first thickness about the circumference and/or the length, and a second portion of a second thickness is different from that of the first thickness about the circumference and/or the length. In such a configuration, the article can be worn with a thinner portion predominately on one side of the wrist or arm and a thicker portion on the opposite side of the wrist or arm. In some embodiments the thinner portion is worn on the inner side of the wrist e.g., adjacent the palm side of the hand. In this configuration, the thinner portion of the sports band allows for greater clearance so as to not obstruct an object held in the user's hand, such as a ball, football, bat, stick or other sporting equipment. In addition, the thinner inside of the wrist of the presently disclosed sweatband may be more comfortable to an athlete wearing a glove, mitt, or a brace, as it may reduce pressure against the glove, mitt or brace as well as the wrist area. Thus, the present article, when configured as a wristband would provide for more range of motion than conventional wristbands that are of a substantially uniform thickness.

The tubular-like article 100 can be knit on a circular knitting machine of the type which permits selected courses to be plain knit and selected courses to be Terry loop or pile knit, to the completion of a seamless tubular article of desired circumference and length. In some embodiments, the tubular-like article is manufactured in a circular knitting machine that creates a tubular-like welt which is shed from the needles in a completed welt state and where at least a portion of the tubular-like welt has a thick and a thin section having a transition region between the thick and thin sections.

Embodiments of the present disclosure now will be described more fully hereinafter with reference to the accompanying drawings, in which embodiments of the present disclosure are shown. This present disclosure may, however, be embodied in many different forms and should not be construed as limited to the embodiments set forth herein. Rather, these embodiments are provided so that this disclosure will be thorough and complete, and will fully convey the scope of the claims to those skilled in the art. Like numbers refer to like elements throughout.

Figure 2A:
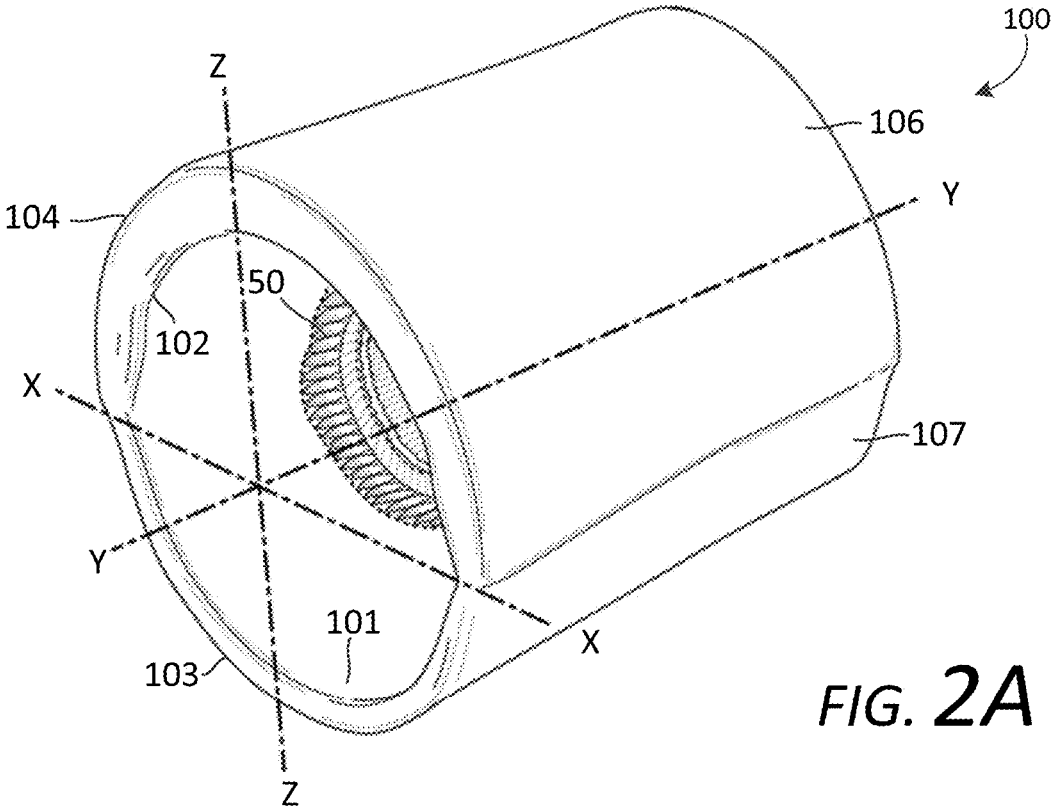
FIG. 2A is a perspective view of an article embodiment as described and disclosed herein shown relative to a X-Y-Z coordinate axis.
Figure 2B:
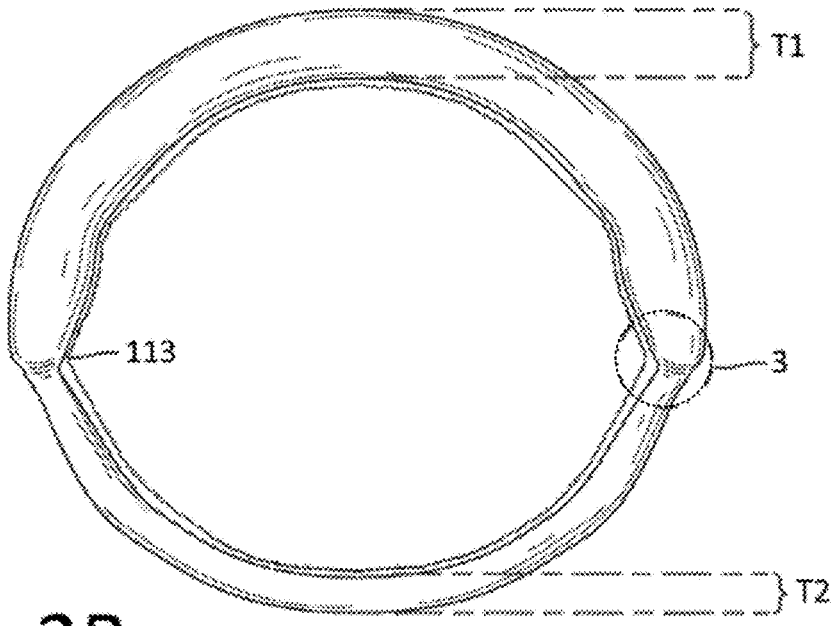
FIG. 2B is a plan edge view of the article of FIG. 1.
Figure 3:
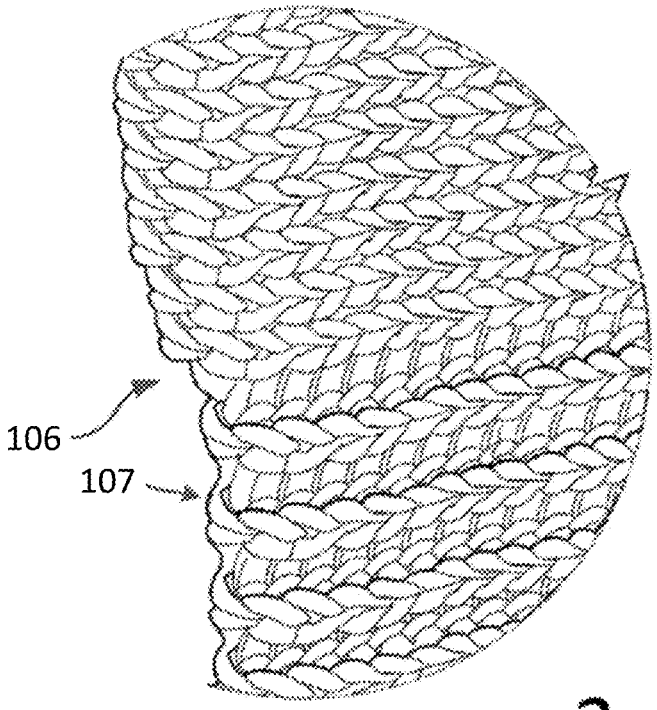
FIG. 3 is an expanded view of section 3 of FIG. 2 showing a transition in the welt.
Figure 4:
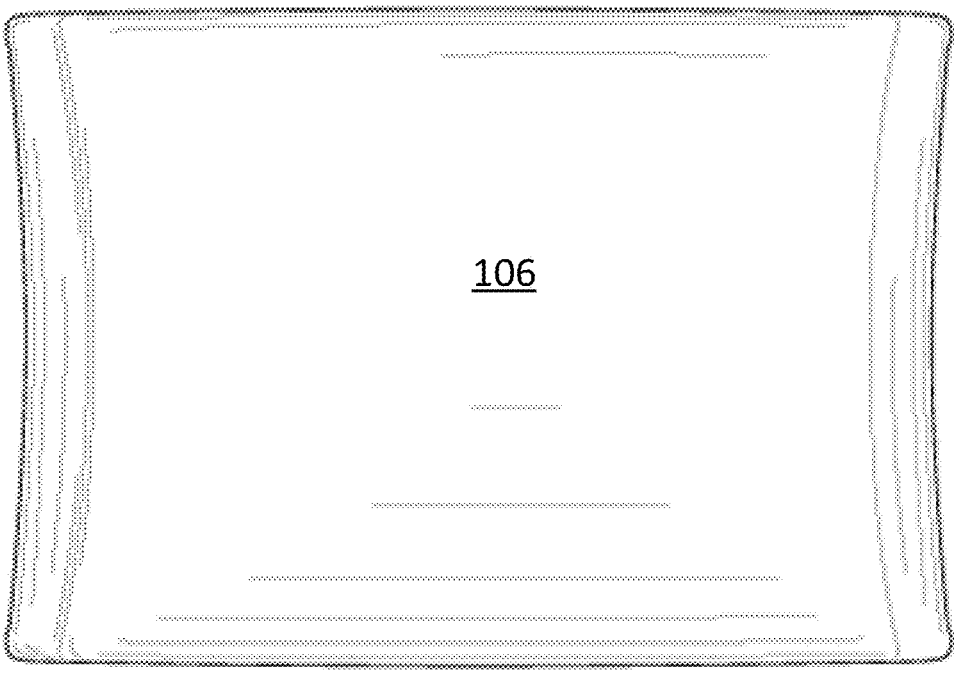
FIG. 4 is a top plan view of the article of FIG. 1.
Figure 5:
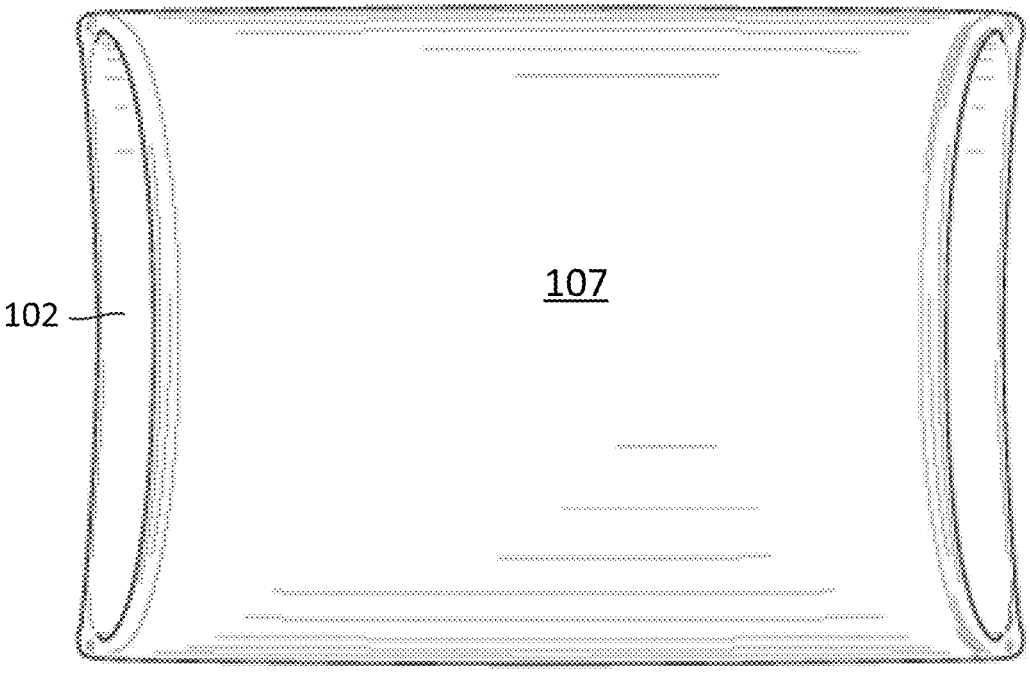
FIG. 5 is a bottom plan to of the article of FIG. 1.
Figure 6:
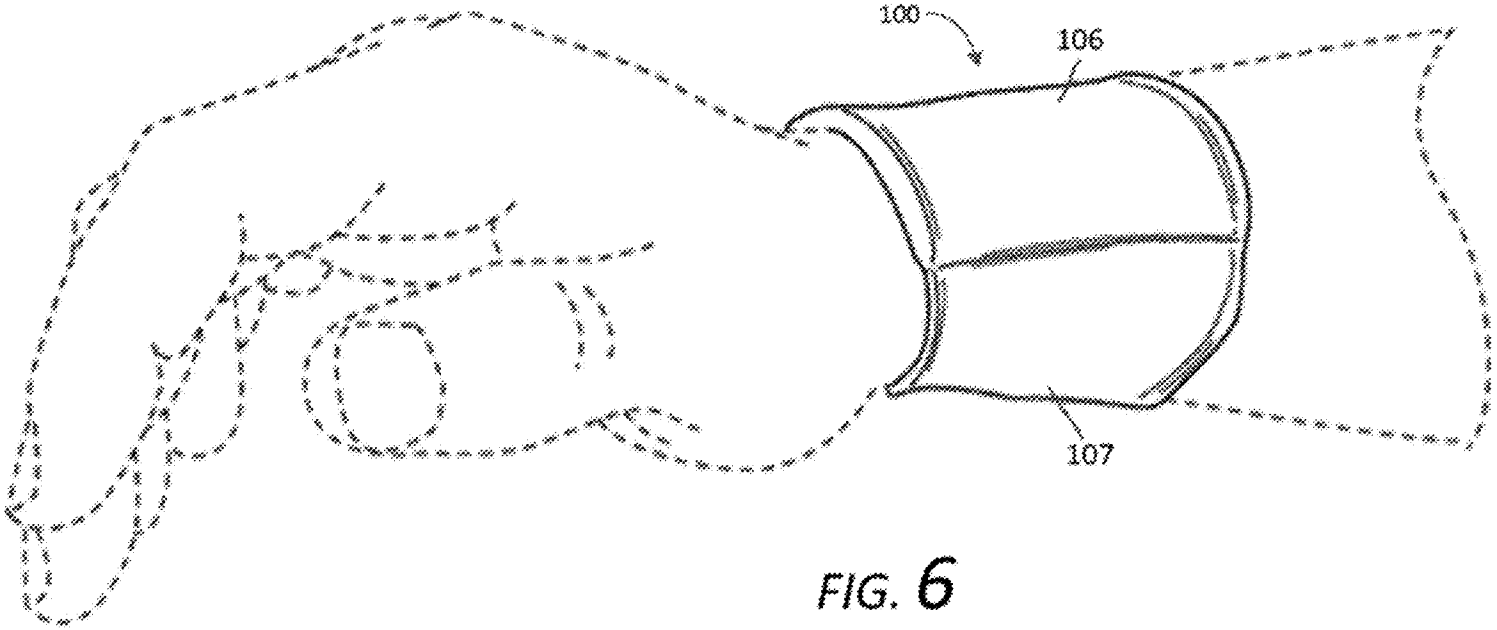
FIG. 6 is a perspective view of the article of FIG. 1, configured as a wristband, illustrating a manner in which it can be worn and as it may appear when extended over the wrist area and a portion of the lower arm.

FIGS. 2A through 6 illustrate an embodiment of the present disclosure of article 100 which is a tubular-like knit article. In some embodiments, tubular-like article is adapted to be worn around the wrist. In other embodiments, tubular-like article is adapted to be worn around the arm, knee, or head. The article 100 generally comprises a welt having a first portion 106 and a second portion 107 along the longitudinal length (as shown by Y axis). As shown in FIG. 2A, 2B, first portion 106 extends longitudinally and symmetrically from second portion 107 about the X axis. First portion 106 of article 100 comprises a wall thickness T1 defined by skin-facing inner surface 102 and outer surface 104 which is thicker than second portion 107 of the article 100, which has a wall thickness T2 as defined by skin-facing inner surface 101 and outer surface 103. The circumference of the skin facing inner surface is generally symmetric, whereas the circumference of the outer surface is generally non-symmetric. In some embodiments, first portion 106 has a wall thickness that is 1.5 times greater than a wall thickness of the second portion. In other embodiments, first portion 106 has a wall thickness that is that least 2 times greater than a wall thickness of the second portion. In some embodiments, first portion 106 has a wall thickness that is at least 3 times greater than a wall thickness of the second portion. First portion 106 can be more than 3 times greater in wall thickness than the second portion, however, in preferred embodiments, first portion 106 may be no more than 5 times greater in wall thickness than the second portion. The generally tubular shape body has an inner skin-facing surface and an outer surface, wherein the inner surface has a circumference that is generally symmetric and the outer surface circumference is generally non-symmetric. In some embodiments, article 100 has a longitudinal axis (Y-axis), and a difference in the first thickness T2 and the second thickness T1 is substantially the same along the entire longitudinal axis of the article. It is understood that the difference in thickness may extend along 1) the entire longitudinal axis (Y-axis), 2) a substantial length, or 3) only a portion of the length. In some embodiments, T1 is about 3.9 mm to about 5 mm in cross-sectional thickness and T2 is about 1.9 mm to about 3.0 mm in cross-sectional thickness. In other embodiments, T1 is about 4.0-5.0 mm in cross-sectional thickness and T2 is about 2.0-2.5 mm in cross-sectional thickness. In contrast, many commercial wristbands are about 5 mm in uniform thickness along the longitudinal length.

Preferred fibers used in constructing the tubular-like article are selected from natural fibers such as cotton because of its durability and absorbency, but, cotton blends can be used, such as cotton/polyester, cotton/nylon, cotton/acrylic, or many other such blends of natural and manmade fibers. One or more elastic yarns can be incorporated in the welts to improve stretchability and a snug fit on the wearer. The yarns can of 100% cotton, cotton/synthetic, or other combinations of natural or synthetic yarn blends. One hundred percent cotton yarn provides the greater absorbency and durability, but any desired blend of natural and/or synthetics fiber yarn is satisfactory. As with any selection of yarn to be worn on the body, it is desirable to lay in or knit in a spandex or other elastic yarn in the welt to improve the stretch fit. Although the plain knit stitch will provide some stretch, the introduction of an elastic yarn will substantially improve fit and performance of the welt.

In some embodiments, combinations of hydrophilic and hydrophobic yarns are used. In other embodiments, combinations of elastomeric, hydrophilic, and hydrophobic yarns are used. Hydrophilic yarns include nylon, polyester, acrylic, and polylactide, and the like or other natural or synthetic fibers that are treated so as to have a hydrophilic surface. Hydrophobic yarns include polypropylene, polyethylene and/or their blends. Elastic yarns include spandex, polyurethane and their blends, and the like.

Figure 7:
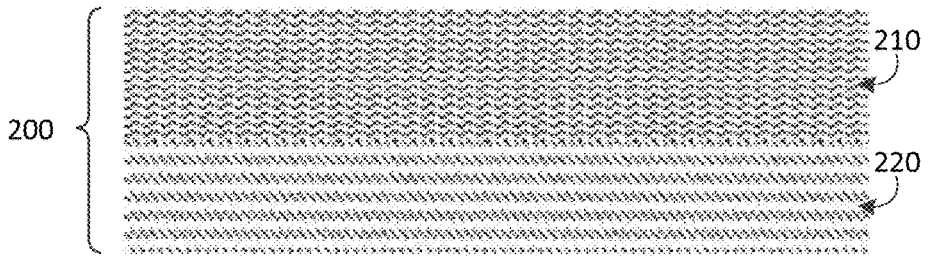
FIG. 7 is an exemplary cross-sectional view of a coursewise direction (along the Y section plane) of a welt as disclosed and described herein.
Figure 8A:
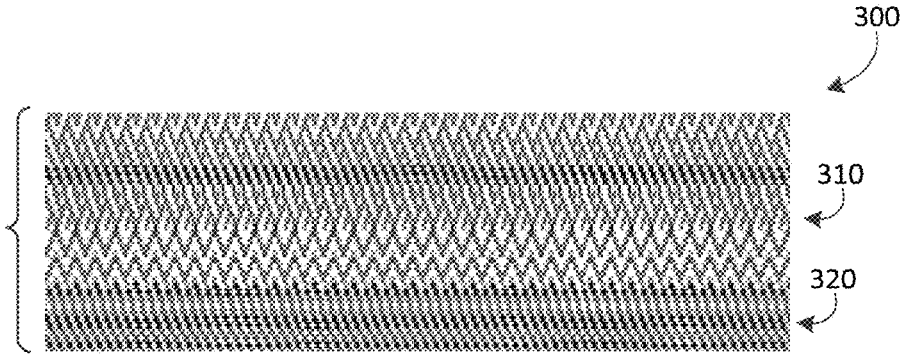
FIG. 8A is another exemplary cross-sectional view of a coursewise direction (along the Y section plane) of a welt as disclosed and described herein.
Figure 8B:
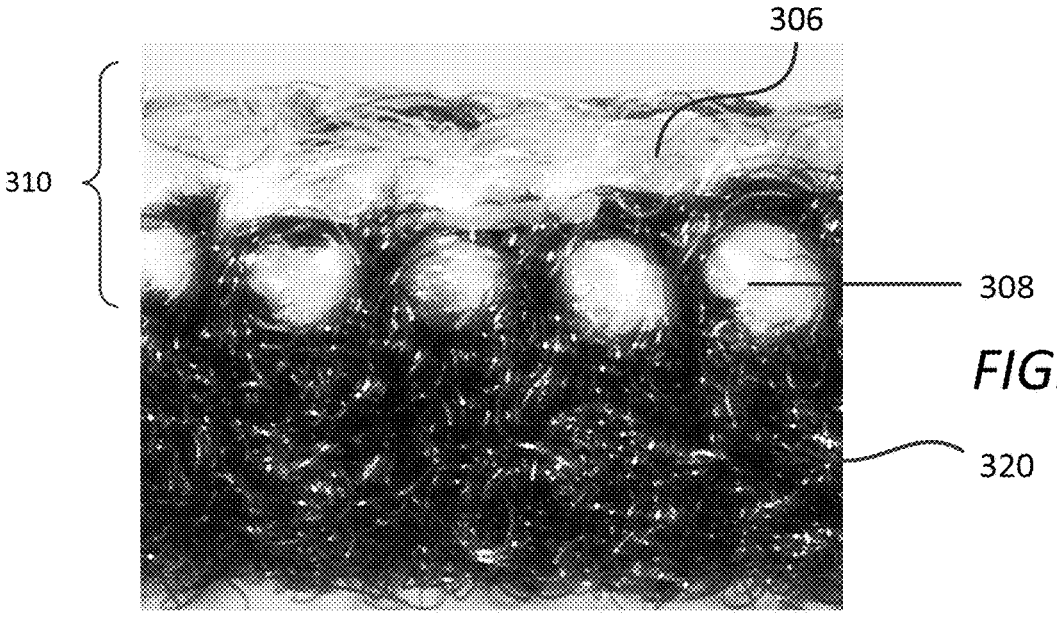
FIG. 8B is an exemplary cross-sectional view of a coursewise direction (along the Y section plane) of the welt of FIG. 8A.

With reference to FIGS. 7, 8A, 8B, the course-wise sectional view of depictions of various layering of elastomeric, hydrophilic, and hydrophobic yarns are exemplified. Other combinations and arrangements of fiber layers can be used to the extent possible using a circular knitting machine provided that non-concentric tubular-like articles are prepared. Thus, with reference to FIG. 7, welt layer 200 may comprise skin-side layer 220 comprised of hydrophobic fibers or elastic fibers and hydrophobic fibers within layer 210 comprising hydrophilic fibers. Layer 210 can be interwoven directly to skin-side layer 220 and have a gradient transition of fibers at the intersection of the layers. Various thicknesses of layers 220 and 210 can be used. In some embodiments, layer 220 is thinner than 210 and/or comprises a layer of fewer courses.

As no single fiber technology can attract and repel moisture at the same time, in some embodiments, two different fiber technologies interwoven together to form inner and outer layers can be used. Such combinations of fibers can include hydrophobic (or superhydrophobic) sweat repelling fibers in combination with water absorbing fibers more distantly positioned from the sweat producing skin. While not to held to any theory, such (super) hydrophobic fibers are technically not "wicking" fibers as they repel rather than transport water. At the molecular level, moisture doesn't adhere to the inner layer of certain hydrophobic fiber terry loop knits. Because sweat (moisture) does not adhere to the hydrophobic fiber, it can be analogized to mechanically lifting the sweat off the skin like a squeegee (as the article is under elastic stress during use, into a moisture attracting outer layer comprised of the hydrophilic fiber without retaining substantial amounts of moisture keeping the wearer's wrist for example, dry and comfortable in or in contact with all types of sports gear, in cold, hot and even wet conditions.

Thus, with reference to FIG. 8A, welt layer 300 comprises a multilayer construction of course wise welts that includes a skin side layer 320 typically of hydrophobic fibers or elastic fibers and hydrophobic fibers and multilayer 310 comprising hydrophilic fibers with one or more interwoven courses of hydrophobic fibers. The outer surface of welts 200, 300 can comprise additional interwoven course-wise layers to facilitate decorative printing and/or indicia functionality. FIG. 8B provides an alternate arrangement of layers and fiber orientation of multilayer 310 comprising hydrophilic fibers with one or more interwoven courses of hydrophobic fibers 306, with substantially oriented fibers 308 adjacent skin side layer 320. Fibers 306 and 308 can be of the same composition of hydrophobic fiber or different hydrophobic fiber. Article 300 with the arrangement of FIG. 8A can provide improved performance to the wearer in that sweat is removed from the skin and urged to the non-skin facing side. Article 300 can be included in a laminate of other fabric layers.

Figure 9A:
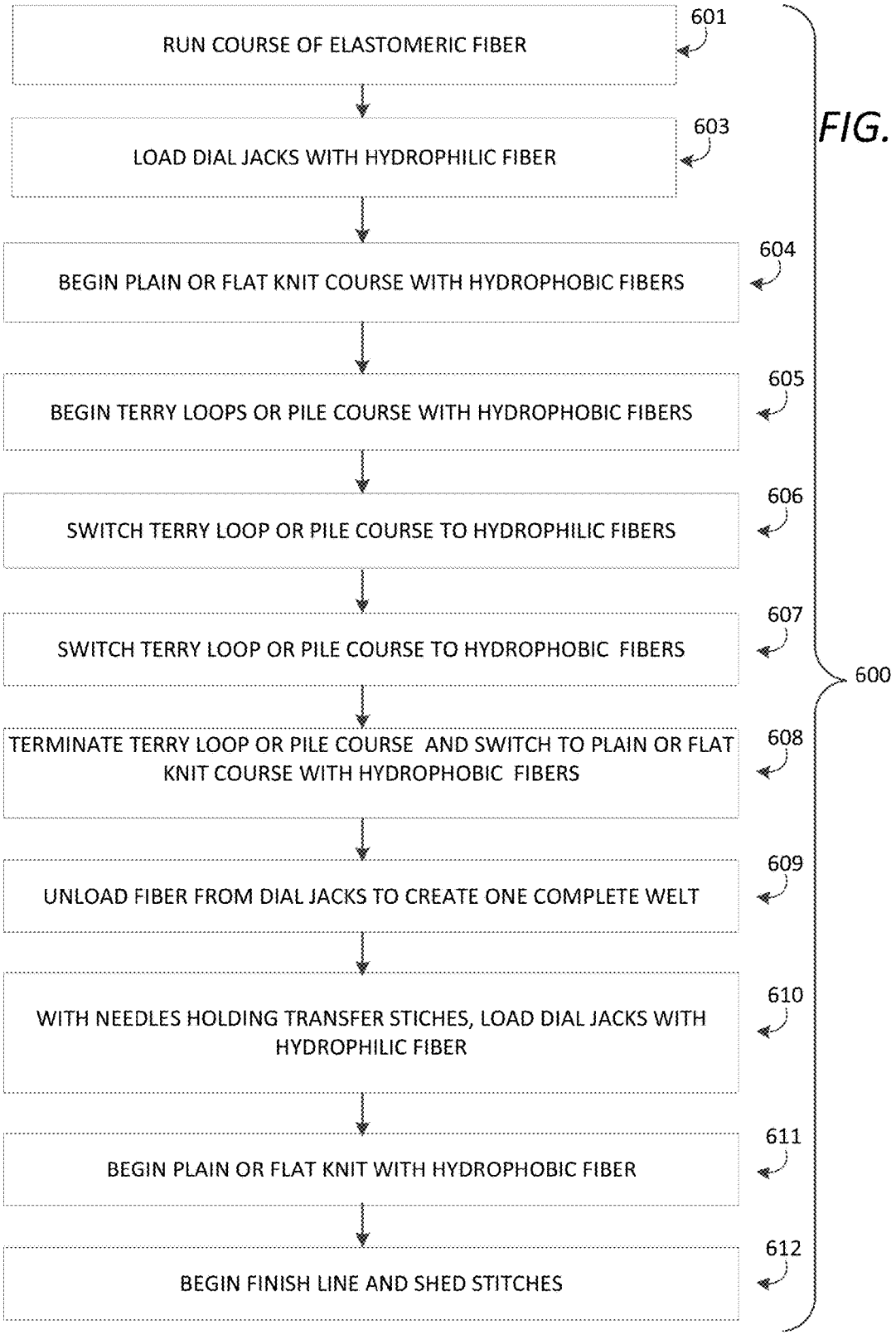
FIG. 9A is a process flowchart of an exemplary manufacturing method for providing the article disclosed and described herein.

With reference to FIG. 9A, a manufacturing process 600 of an embodiment of the present article is provided. Thus as shown in Step 601 a makeup course is knitted, using a Terry Loop or Pile stitch of several courses. In some embodiments, the makeup comprises several courses of elastic fiber such as spandex. At the completion of the desired number of courses comprising the makeup, the dial jacks are loaded with a hydrophilic fiber, as in Step 603, such as nylon. Courses of plain/knit with hydrophobic fiber is knitted with the fiber, as in Step 604 with the fibers that loads the dial jacks removed. In some embodiments, Step 604 includes 3 to 4 courses. In Step 605 the Terry loop or pile course is begun using hydrophobic fibers. In some embodiments, Step 605 is run for 50-70 courses. The Terry loop/pile knit is continued after Step 605 with the transition to hydrophilic fiber, as in Step 606. In some embodiments, Step 606 is run for approximately 100-150 courses. Continuing the Terry loop/pile knit courses, the fiber is transition to hydrophobic fiber as in Step 607. In some embodiments, Step 607 is run for approximately 50-70 courses. In Step 608, the Terry loop/pile knit courses are terminated and, while still using hydrophobic fiber, a plain or flat knit course is used. In some embodiments, Step 608 is run for 2-10 courses. In Step 609, fibers are unloaded from the dial jacks so as to create one complete welt. In some embodiments, fiber previously loaded on the dial jacks (Step 603) is unloaded by extracting jacks that are located on either side of needles. This step permanently connects steps 601-608 to create one complete welt. In some embodiments this provides a wristband as disclosed and described herein. In Step 610, with needles holding transfer stitches from step 609, Step 603 is repeated, whereby dial jacks are loaded with hydrophilic fiber. In Step 611, Step 604 is repeated, whereby a plane or flat knit course with hydrophobic fibers is run. At this point, the finish line is started, as in Step 612, so as to shed stitches without unraveling.

Figure 9B:
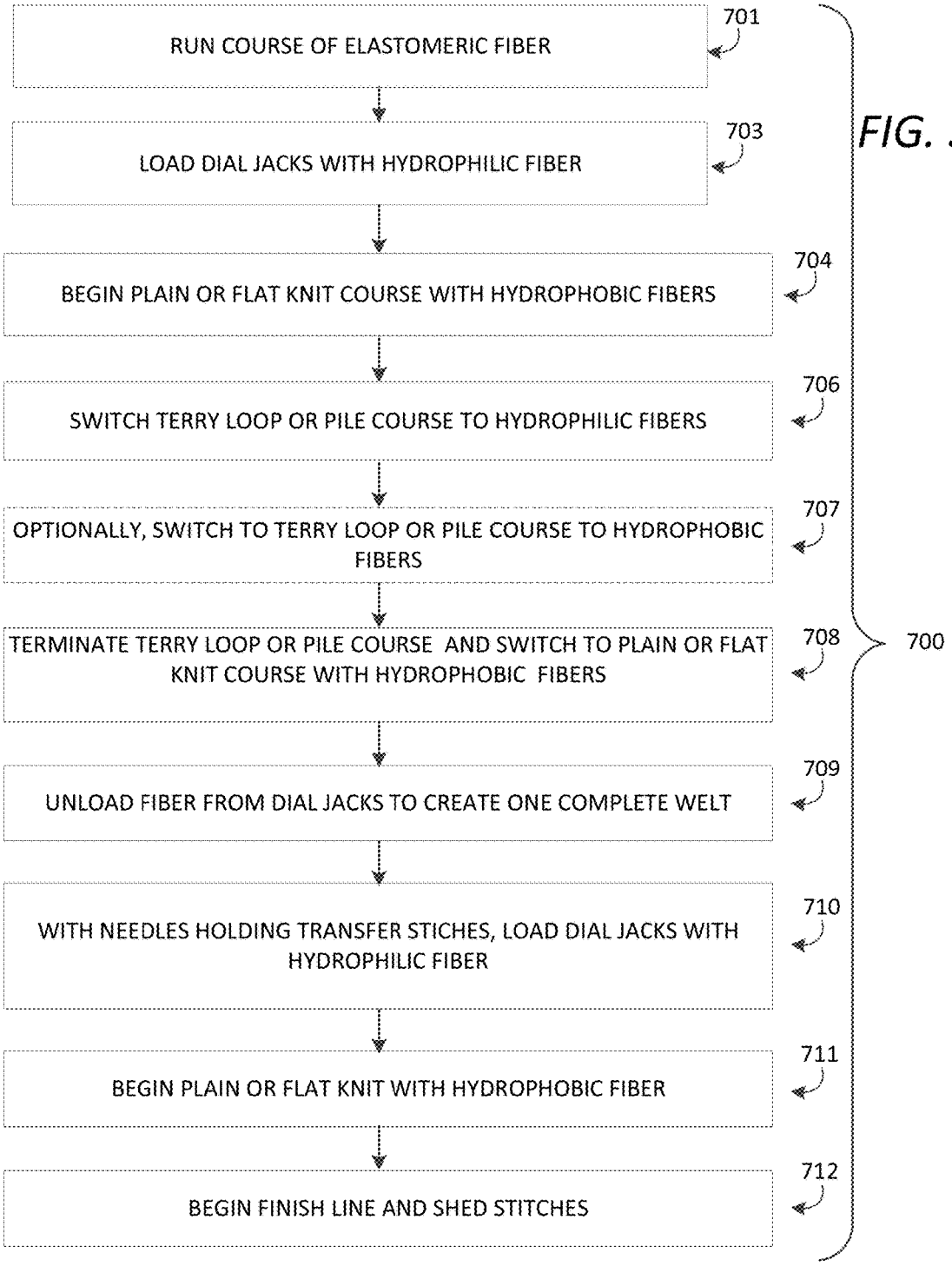
FIG. 9B is a another process flowchart of an exemplary manufacturing method for providing the article disclosed and described herein.

With reference to FIG. 9B, an alternate manufacturing process 700 of an embodiment of the present article is provided. Process 700 differs from that of process 600 in that Step 605 is eliminated and Step 607 is optional. Thus, as shown in Step 701 a makeup course is knitted, using a Terry Loop or Pile stitch of several courses. In some embodiments, the makeup comprises several courses of elastic fiber such as spandex. At the completion of the desired number of courses comprising the makeup, the dial jacks are loaded with a hydrophilic fiber, as in Step 703, such as nylon. Courses of plain/knit with hydrophobic fiber is knitted with the fiber, as in Step 704 with the fibers that loads the dial jacks removed. In some embodiments, Step 704 includes 3 to 4 courses. A Terry loop/pile knit is then used with hydrophilic fiber, as in Step 706. In some embodiments, Step 606 is run for approximately 100-150 courses. The Terry loop/pile knit courses can optionally transition to hydrophobic fiber as in Step 707 for approximately 50-70 courses, but this step can be eliminated. In Step 708, the Terry loop/pile knit courses are terminated and, while using hydrophobic fiber, a plain or flat knit course is then used. In some embodiments, Step 708 is run for 2-10 courses. In Step 709, fibers are unloaded from the dial jacks so as to create one complete welt. The remaining steps 710-712 are as described in Steps 610-612 of process 600

To make the outside surface of the article thicker, the terry loops/pile loops can be substantially hydrophilic yarns, which may improve the performance attributes of the article for certain applications while reducing cost and manufacture complexity.

In some embodiments, on completion of the desired plain knit courses, the make-up fiber is looped over dial jacks that run on either side of the terry needles so that after a length of fabric is knit, the dial jacks can transfer the make-up, essentially folding the fabric inward and back on itself.

Figure 10A:
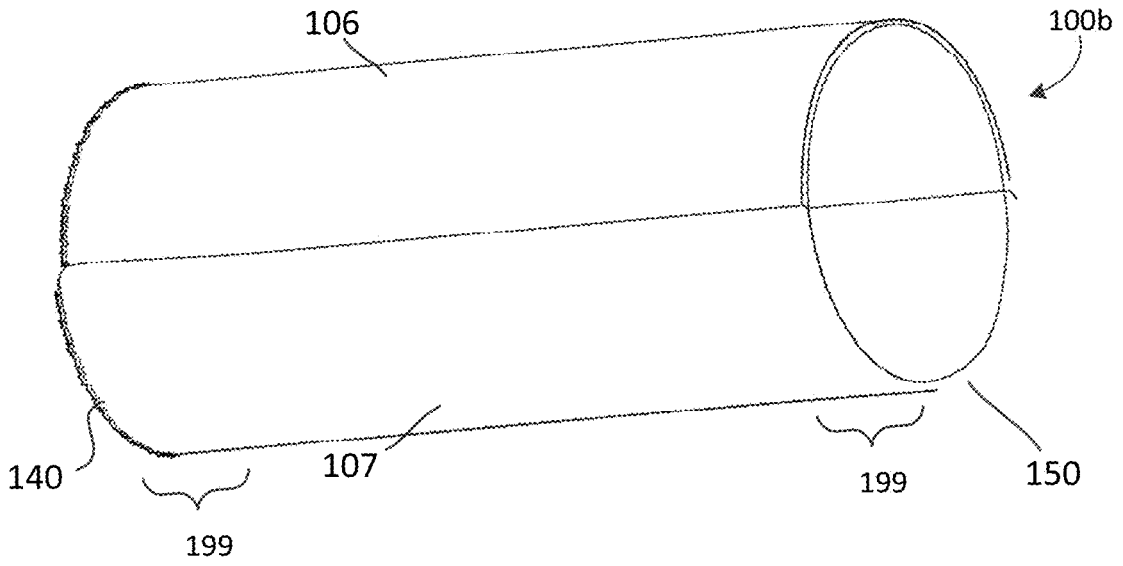
FIG. 10A is a perspective view of a completed welt prior to finishing to form the article of FIG. 1.
Figure 10B:
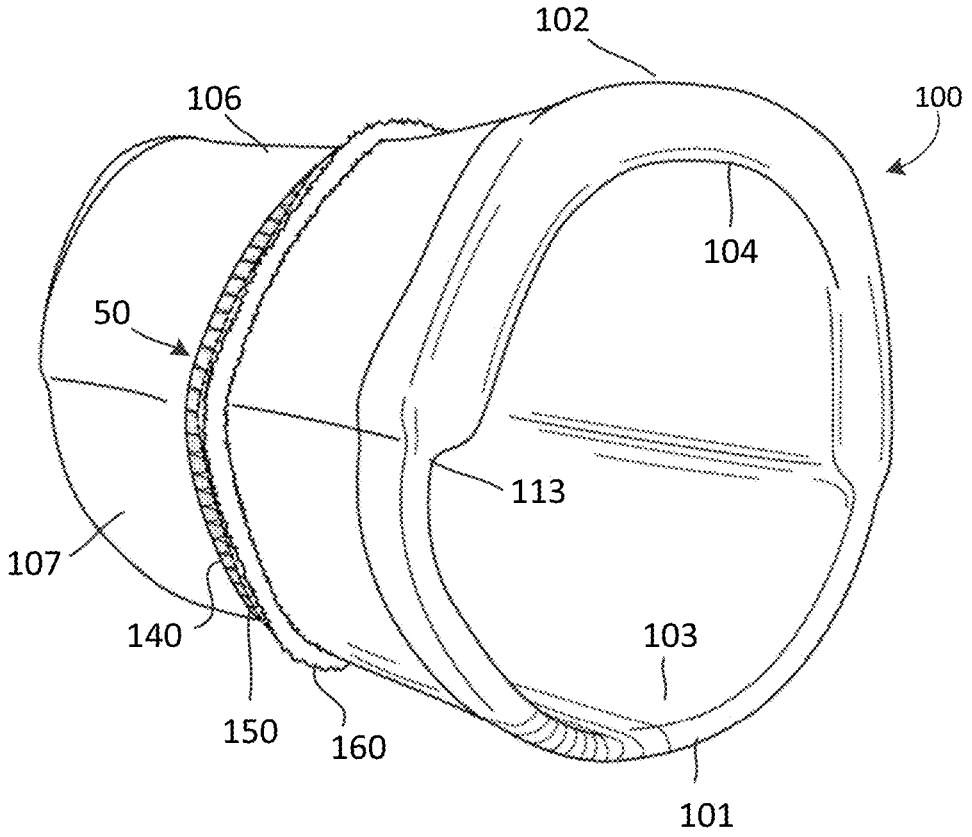
FIG. 10B is a perspective view of the article of FIG. 1 turned inside out to show finish line stitching.

In FIG. 10A, the complete welt 100 *b* (from step 609. 709) is shown and as an alternative embodiment, the end sections 199 can be seamed or stitched to provide an elongated article. As shown in FIG. 10B, welt 100 *b* is processed further as in Steps 610-612, 710-712) and end sections are seamed together as is shown in FIG. 10B with welt 100 *b* turned inside out, having makeup end 140 and dial jack fiber ends 150 on opposite end of article joined together at seam 50. The article can be knit on a circular knitting machine of the type which permits selected courses to be plain knit and selected courses to be Terry loop or pile knit, to the completion of a seamless tubular-like article 100 *b* of desired circumference and length. Circular knitting machines are well known in the art, such as a UNIPLET Model is ANGE 18.1144 needle machine. Other circular knitting machines can be used, for example, a Lonati or San Jacomo, and the number of needles of the machine can be 108, 120, 168, 172, or 200, for example. The manufacture of the article, e.g., sweat band can employ manipulation of the yarns and/or needles, cams, and dial jacks during the knitting process as is known by one of skill in the art. As will be understood, various types of circular knitting machines could be employed for manufacture of the sweat band.

Byway of example, a wristband as disclosed and described can be manufactured in a circular knitting machine that creates a tubular-like welt 100*b*, which is shed from the circular knitting machine needles in a completed state, and where at least a portion of the tubular-like welt has a thick section 106 and a thin section 107. To create the thick/thin sections, in some embodiments, a terry lever is deactivated and centrifugal force causes the sinkers to move to an outward position, the fibers knit on the lowest point of the sinkers that are located on either side of the needles creating transition region 113 between the thicker first section 106 to the thinner section 107.

To complete the formation of the wristband, makeup end 140, which is formed during a second step in the makeup is joined with opposing end 150. For example, the fiber is looped over dial jacks that run on either side of the needles so that after a length of fabric is knit, the dial jacks can transfer the makeup end 140, essentially folding the fabric inward and knitting the looped dial jack fiber end 150 back into the needles where it becomes permanently stitched together. Finish line 160 is performed using the needles holding single stiches of fabric that is cast off the needles using a combination of dial jacks and needle cams manipulations without un-raveling the finished welt 100*b*. Other methods of joining the opposing ends can be used.

Referring now to FIGS. 11A, 11B, 12A, and 12B an alternate embodiment of articles 400, 500 are depicted. The indicia 450 on the welt is knitted in and can represent a logo, trademark, name, ornamental indicia, or universal number/letter template for end-user manipulation. As previously explained, the indicia 450 can be knitted in or printed or stamped on the surface. Preferably indicia 450 is created during the knitting process used to create the article. With the welt portions available for such indicia, articles 400, 500 are superior to prior known bands which employ tape, silk screen, or heat-set markings which can crack upon stretching when the article is used.

Figure 11A:
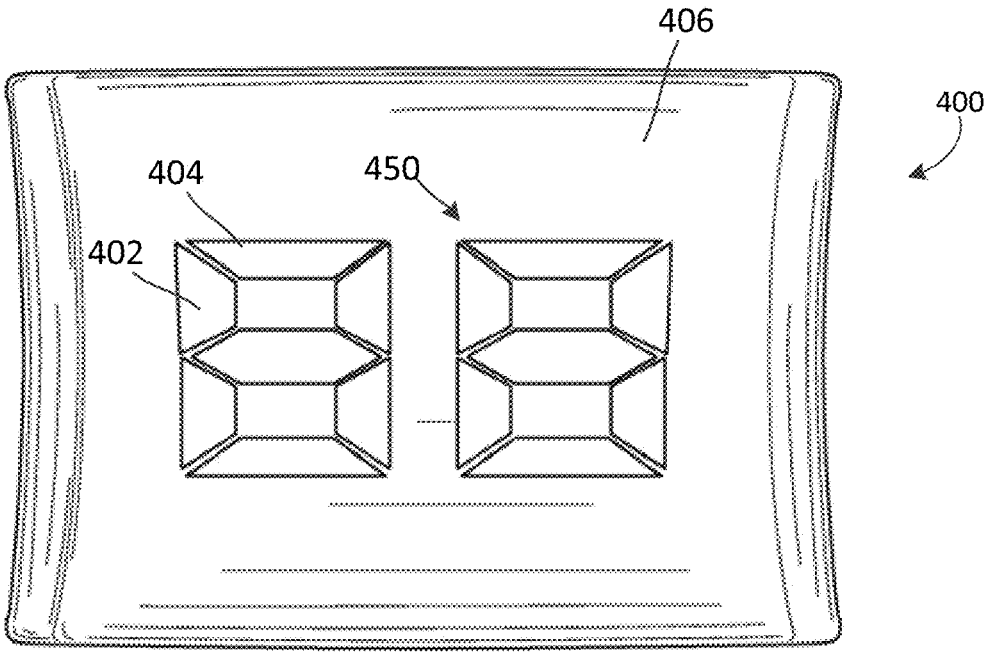
FIG. 11A is a perspective view of another article embodiment with universal numbering indicia as described and disclosed herein.
Figure 11B:
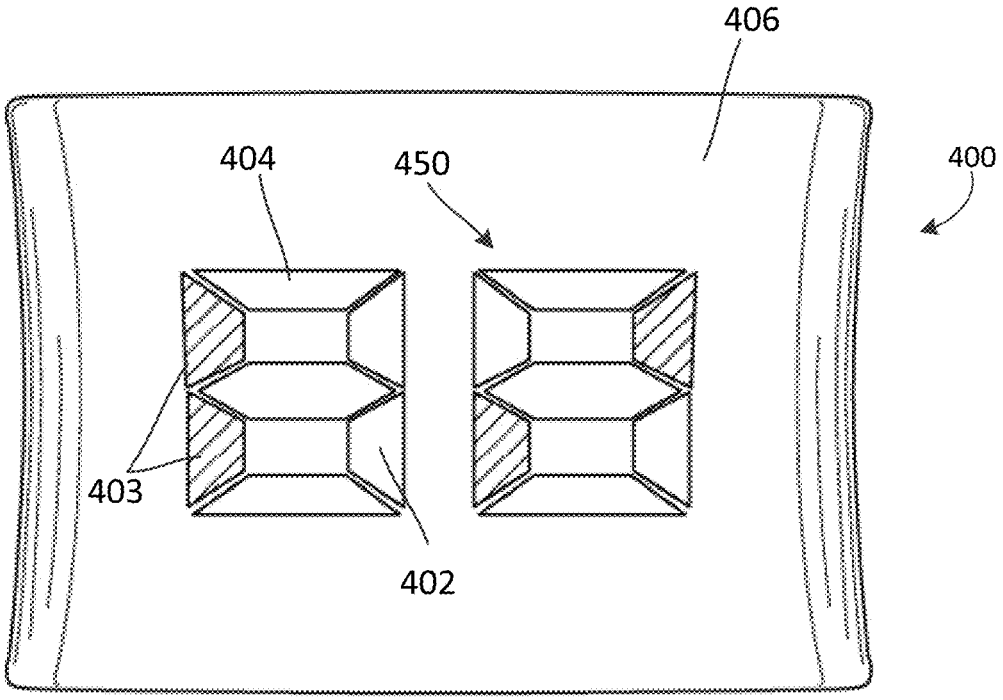
FIG. 11B is a perspective view of the article of FIG. 11A with the universal numbering indicia modified as described and disclosed herein.

Thus, with reference to FIGS. 11A, 11B an article comprising a universal number template 450 is provided. Template 450 is shown on the first portion 406 (thicker) of article 400, and comprises vertical and horizontal segments 402, 404 that are incorporated in the welt, e.g., dropped in during the knitting process or applied to the surface by separate stitching or knitting, printing, dyeing, or any of several known methods of application. In some embodiments, the welts are knitted in a plain stitch to facilitate the application of indicia. As shown in FIG. 11B, the indicia is configured to be manipulated by the end-user to provide a letter, number, or sequence of letters and/or numbers by color matching or color contrasting the horizontal segments 402, 404 to provide altered segments 403 in the universal number template 450 with that of the surrounding welt. In one aspect, the color matching or color contrasting of the indicia is by use of a marker, such as a laundry marker, magic marker, indelible marker, washable marker, a Sharpie® or dye. The yarn used for the indicia may be configured to absorb and/or accept a particular color, dye, or marker different from that of the surrounding welt. Alternatively, the surrounding welt can be configured with suitable coatings and/or yarn so that it is resistant to absorbing a particular color, dye, or marker used for color matching or color contrasting the indicia.

Figure 12A:
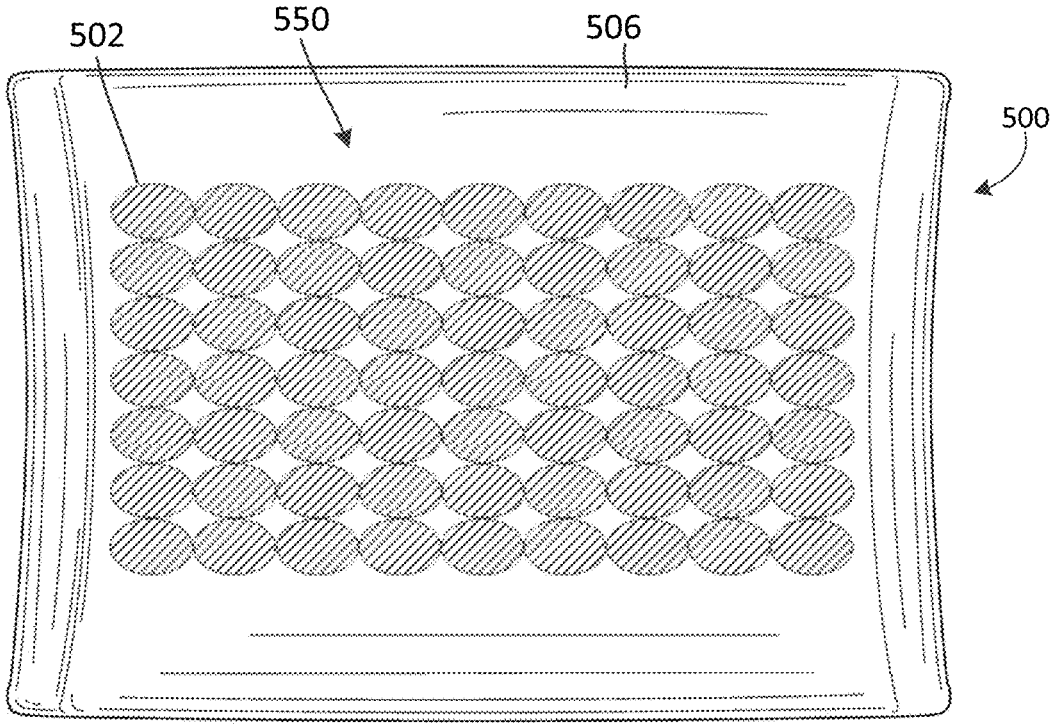
FIG. 12A is a perspective view of another article embodiment with universal lettering and/or numbering indicia as described and disclosed herein.
Figure 12B:
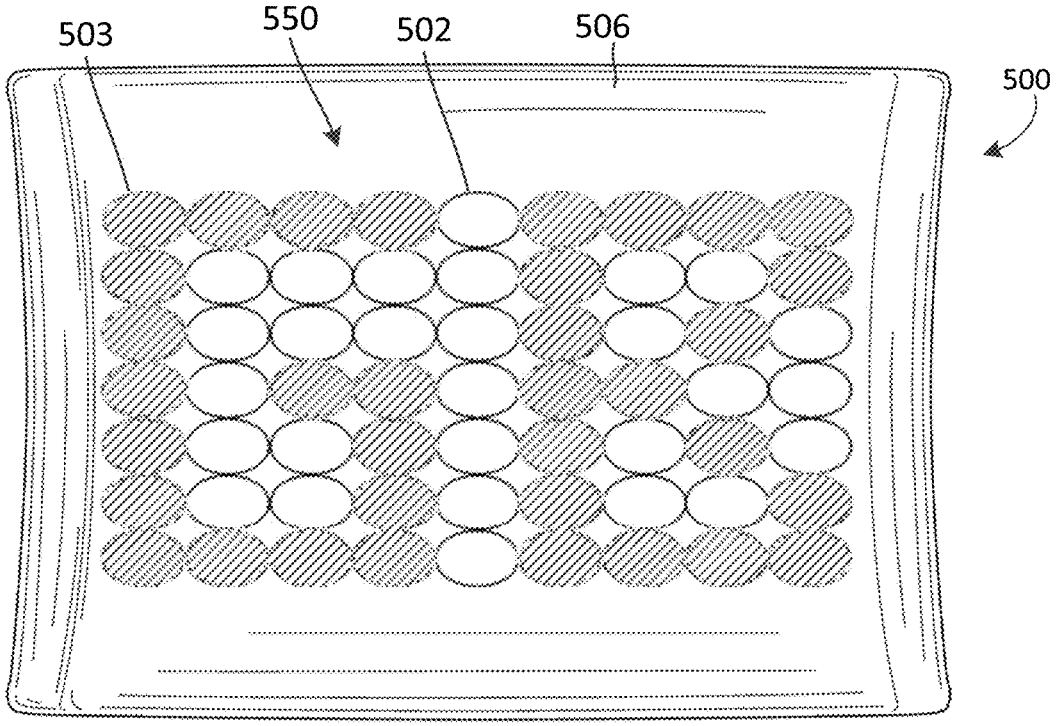
FIG. 12B is a perspective view of the article of FIG. 11A with the universal lettering and/or numbering indicia modified as described and disclosed herein.

With reference to FIGS. 12A, 12B, an alternate article concept is depicted, where a plurality of universal letter/number template components 502 are arranged in matrix-like array 550 on the first section 506 of article 500. Manipulation of the components 502 to provide altered components 503 produces user-desired letters or numbers. The components 502 can be the same or different color to that of the surrounding fabric and can be altered to match the surrounding fabric, or, alternatively, to be different color than that of the surrounding fabric. The article can be sold as a kit with a marker for color contrasting or coloring the components 502. The fabric and/or stitching of components 502 can be the same as the surrounding fabric or can be of a type to absorb marker colors. Combinations of the universal letter and universal number templates can be used, or a defined area (circle, square, diamond, or rectangle shape) can be provided as suitable for providing indicia.

Figure 13A:
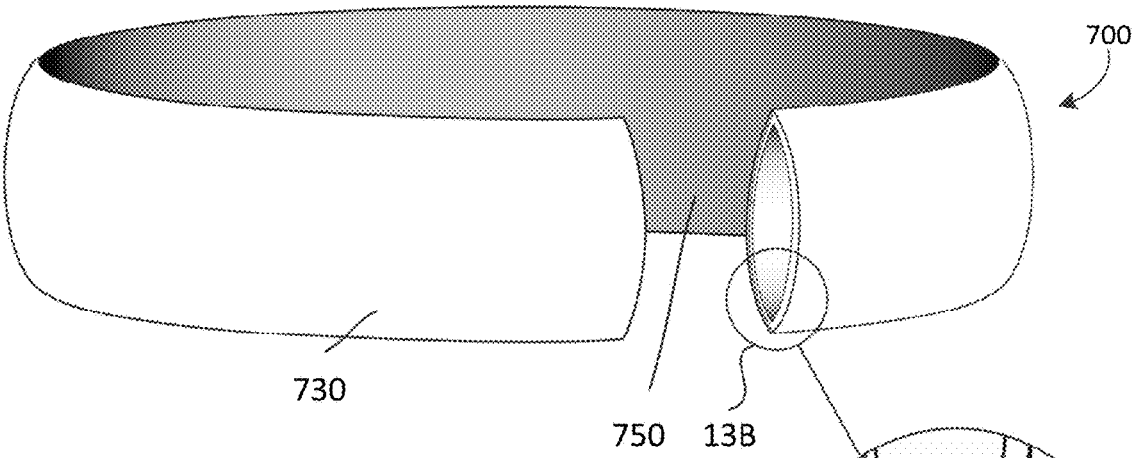
FIG. 13A is a perspective view of another article embodiment including metal interwoven or impregnated with the fabric.
Figure 13B:
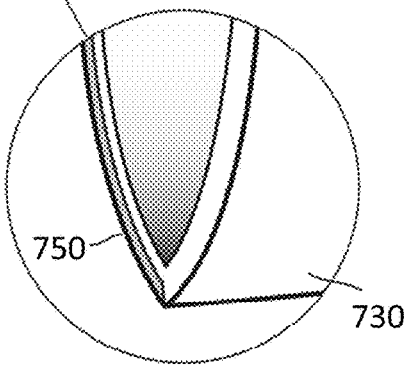
FIG. 13B is an expanded view of section 13B of FIG. 13A.

With reference to FIGS. 13A, 13B, an alternate concept of an article is shown where the article 700 comprises a metal 750, such as copper or silver, or one or more other ferromagnetic or magnetic metals or metal compounds dispersed in yarn or interwoven as a fiber into the fabric 750 of the article. Section 13B shows expanded view of cross-section of the article. Metal-containing hydrophobic fiber layer 750, e.g., copper in polyolefin is knitted or interwoven with hydrophilic layer 730 intended to be more distant from skin than metal layer 750. Metal can be incorporated in fiber or can be arranged on a knitted fabric as dots, e.g., by hot stamping or reductively deposited into the fabric for example, by electrolytic methods. Metal can be used in any of the presently disclosed articles for one or both of therapeutic or aesthetic function, and can be combined with any of the previously described embodiments.

Any aspect or features of any of the embodiments described herein can be used with any feature or aspect of any other embodiments described herein or integrated together or implemented separately in single or multiple components.

It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof Unless otherwise defined, all terms (including technical and scientific terms) used herein have the same meaning as commonly understood by one of ordinary skill in the art to which this present disclosure belongs.

Although specific embodiments have been illustrated and described herein, those of ordinary skill in the art appreciate that any arrangement, which is calculated to achieve the same purpose, may be substituted for the specific embodiments shown and that the present disclosure has other applications in other environments. This application is intended to cover any adaptations or variations of the present disclosure. The following claims are in no way intended to limit the scope of the present disclosure to the specific embodiments described herein.

What is claimed is:

1. An article of fabric comprising:

a tubular shaped body having a longitudinal length;

a first open end;

a second open end;

a symmetric inner circumference along the longitudinal length of the tubular shaped body;

a non-symmetric outer circumference along the longitudinal length of the tubular shaped body, the non-symmetric outer circumference comprising:

a first semi-circumferential portion of the outer circumference having a first thickness of courses; and a second semi-circumferential portion of the outer circumference having a second thickness of less courses so as to provide the non-symmetric outer circumference, the second semi-circumferential portion being opposed from the first semi-circumferential portion along the longitudinal length.

2. The article of claim 1, wherein a difference in the first thickness and the second thickness is 1.5 to 5 times along the entire longitudinal length of the article.

3. The article of claim 1, wherein the outer surface is a Terry loop or pile knit course.

4. The article of claim 1, wherein the hydrophobic yarn further comprising a metal.

5. An article of fabric comprising a tubular shaped body consisting of a knitted or a woven fabric, the tubular shaped body having an inner skin-facing surface and an outer-facing surface interwoven with the inner skin-facing surface;

wherein the article of fabric includes an indicia on the outer-facing surface, wherein the indicia is one structure consisting of seven segments or two adjacent structures each of which consist of seven segments forming a universal number template for one or two side-by-side numbers, each of the one or two adjacent structures comprising physically separated vertical and horizontal segments.

6. The article of claim 5, wherein the indicia is a dropped in knitted shape of at least one segmented structure representing an Arabic number 8 or a matrix-like arrangement of circles, ovals, squares or rectangles.

7. The article of claim 5, wherein the inner skin-facing surface has a generally symmetric inner circumference and the outer-facing surface has a generally non-symmetric outer circumference; wherein the non-symmetry of the outer circumference extends along a longitudinal axis of the article.

8. The article of claim 5, further comprising a thickness of fabric having a first portion of a first thickness extending the length of the tubular body and extending about half of a circumference of the tubular body, and a remainder portion of a second thickness less than that of the first thickness.

9. The article of claim 5, wherein the first portion is a Terry Loops or Pile stitch and the remainder portion is a flat knit stitch.

10. The article of claim 5, wherein the fabric comprises hydrophobic or hydrophilic yarn or wherein the fabric comprises hydrophobic and hydrophilic yarn.

11. The article of claim 5, further comprising a metal-comprising hydrophobic yarn.

12. The article of claim 5, wherein the fabric comprises at least one layer of hydrophobic yarn in proximity to the inner skin-facing surface and at least one layer of hydrophilic yarn or a combination of hydrophobic and hydrophilic yarn more distant from the inner skin-facing surface than the layer of hydrophobic yarn.

13. The article of claim 12, further comprising elastic yarn.

14. The article of claim 12, wherein said hydrophobic yarn is polypropylene, polyethylene or blends thereof and wherein said hydrophilic yarn is cotton, cotton synthetic blended, wool, nylon, polyester, or acrylic.

* * * * *